US011927404B2

(12) United States Patent
Tong et al.

(10) Patent No.: US 11,927,404 B2
(45) Date of Patent: Mar. 12, 2024

(54) HEAT EXCHANGE TUBE, PROCESSING METHOD FOR SAME, AND HEAT EXCHANGER HAVING SAME

(71) Applicant: SANHUA (HANGZHOU) MICRO CHANNEL HEAT EXCHANGER CO., LTD., Zhejiang (CN)

(72) Inventors: Zhongyao Tong, Zhejiang (CN); Qiang Gao, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 291 days.

(21) Appl. No.: 17/414,189

(22) PCT Filed: Dec. 18, 2019

(86) PCT No.: PCT/CN2019/126272

§ 371 (c)(1),
(2) Date: Jun. 15, 2021

(87) PCT Pub. No.: WO2020/125671

PCT Pub. Date: Jun. 25, 2020

(65) Prior Publication Data

US 2021/0333054 A1 Oct. 28, 2021

(30) Foreign Application Priority Data

Dec. 18, 2018 (CN) ..... 201822127677.8

(51) Int. Cl.

| | |
|---|---|
| ***F28F 1/02*** | (2006.01) |
| ***B21D 53/04*** | (2006.01) |
| *F28F 1/04* | (2006.01) |

(52) U.S. Cl.
CPC ..... *F28F 1/022* (2013.01); *B21D 53/04* (2013.01); *F28F 1/04* (2013.01); *F28F 2275/12* (2013.01)

(58) Field of Classification Search
CPC ..... B21D 53/04; F16L 9/165; F28F 1/022
See application file for complete search history.

(56) References Cited

U.S. PATENT DOCUMENTS 2,373,218 A * 4/1945 Arnold ..... F28F 1/40 29/890.048
2,934,322 A * 4/1960 Hazard ..... F28D 1/0308 62/436

(Continued)

FOREIGN PATENT DOCUMENTS

CN 101832726 A 9/2010
CN 104596340 A 5/2015

(Continued)

*Primary Examiner* — Devon Russell
(74) *Attorney, Agent, or Firm* — Bridgeway IP Law Group, PLLC; Jihun Kim

(57) ABSTRACT

Disclosed are a heat exchange tube, a processing method for same, and a heat exchanger having same. The heat exchange tube (10*a*, 10*b*, 10*c*, 10*d*, 10*e*) includes a body portion (11*a*, 11*b*, 11*c*, 11*d*, 11*e*) provided with a plurality of flow channels (111*a*, 111*b*, 111*c*, 111*d*, 111*e*) arranged in parallel and spaced apart with each other, the length direction of the flow channel (111*a*, 111*b*, 111*c*, 111*d*, 111*e*) being parallel to the length direction of the body portion (11*a*, 11*b*, 11*c*, 11*d*, 11*e*); at least one side of the body portion (11*a*, 11*b*, 11*c*, 11*d*, 11*e*) is provided with an extension portion (12*a*, 12*b*, 12*c*, 12*d*, 12*e*) along the width direction of the body portion (11*a*, 11*b*, 11*c*, 11*d*, 11*e*); and the extension portion (12*a*, 12*b*, 12*c*, 12*d*, 12*e*) and at least part of the body portion (11*a*, 11*b*, 11*c*, 11*d*, 11*e*) are formed by folding the same plate material.

16 Claims, 12 Drawing Sheets

(56) References Cited

U.S. PATENT DOCUMENTS 4,150,657 A * 4/1979 Bowen ..... F24S 80/60 165/169
4,237,971 A * 12/1980 Olsson ..... B21D 53/045 29/521
4,326,583 A * 4/1982 Rudd ..... F24S 10/75 29/890.038
4,428,420 A * 1/1984 Blakely ..... F24S 10/753 138/143
4,732,819 A * 3/1988 Komuro ..... B21C 37/0803 280/798
5,441,106 A * 8/1995 Yukitake ..... F28F 3/046 165/177
5,469,915 A * 11/1995 Cesaroni ..... B29C 66/24221 165/76
5,513,432 A * 5/1996 Sasaki ..... F28D 1/0246 29/890.038
5,979,051 A * 11/1999 Kato ..... B21C 37/28 165/174
5,996,633 A * 12/1999 Kato ..... F28F 3/042 138/116
9,718,111 B2 * 8/2017 Eaton ..... B21D 5/10
11,566,854 B2 * 1/2023 Alahyari ..... F28D 1/05333
2004/0206482 A1 * 10/2004 Bang ..... F28D 1/0435 29/890.03
2006/0243429 A1 * 11/2006 Chu ..... F28F 3/025 165/177
2010/0314092 A1 12/2010 Carlo et al.
2012/0247600 A1 10/2012 Mcnulty

FOREIGN PATENT DOCUMENTS

CN 105318766 A 2/2016
CN 205957548 U 2/2017
CN 108413803 A 8/2018
CN 209310597 U 8/2019
DE 202017102436 U1 * 1/2018 ..... F25B 39/00
EP 0457470 B1 1/1996

* cited by examiner

HEAT EXCHANGE TUBE, PROCESSING METHOD FOR SAME, AND HEAT EXCHANGER HAVING SAME

CROSS-REFERENCE TO RELATED APPLICATION

This application claims priority to Chinese Patent Application No. 201822127677.8 filed with the Chinese Patent Office on Dec. 18, 2018, and entitled "HEAT EXCHANGE TUBE AND HEAT EXCHANGER HAVING SAME", which is incorporated herein by reference in its entirety.

FIELD

This application relates to the field of heat exchange technologies, and in particular to a heat exchange tube, a processing method for same, and a heat exchanger having same.

BACKGROUND

A heat exchanger commonly used in a heat pump water heater is a multichannel heat exchanger. This heat exchanger includes two parallel headers, between which there are arranged a plurality of heat exchange tubes. A plurality of flow channels are arranged inside the heat exchange tube along its width direction. The two headers are in communication with each other through the heat exchange tubes.

In the existing structure, the headers are provided with slots adapted to the heat exchange tubes, ends of the heat exchange tubes are inserted into the headers, and the width direction of the heat exchange tube is parallel to the length direction of the header. In order to ensure the strength, a specific distance needs to be maintained between the slots on the header, and adjacent heat exchange tubes are arranged at a specific distance. This causes an insufficient heat exchange area, and heat exchange performance needs to be improved.

Therefore, how to improve the structure of the existing heat exchange tube to increase the heat exchange area and improve the heat exchange efficiency is a technical problem that needs to be solved by those skilled in the art.

SUMMARY

In order to solve the above technical problem, this application provides a heat exchange tube for a heat exchanger, where the heat exchange tube includes a body portion provided with a plurality of flow channels arranged in parallel and spaced apart with each other, the length direction of the flow channel being parallel to the length direction of the body portion;

at least one side of the body portion is provided with an extension portion along the width direction of the body portion; and the extension portion and at least part of the body portion are formed by folding the same plate material.

The heat exchange tube includes the body portion, and the at least one side of the body portion is provided with extension portion along the width direction of the body portion, where the extension portion and at least part of the body portion are formed by folding the same plate material. Because the extension portion and the part of the body portion are made of the same plate material, they do not need to be connected in an additional connection manner. The arrangement of the extension portion can increase a heat exchange area and improve heat exchange performance.

This application further provides a heat exchanger including two headers arranged in parallel and spaced apart, between which there are arranged a plurality of heat exchange tubes, with the width direction of the heat exchange tube being parallel to the length direction of the header, where the heat exchange tube is the heat exchange tube described above, and the heat exchange tube are in communication with the two headers through the body portion.

Because the heat exchange tube has the above technical effect, the heat exchanger including the heat exchange tube also has a similar technical effect, and details will not be repeated herein.

This application further provides a processing method for a heat exchange tube, the processing method including:

preparing a plate-shaped piece; and folding a first plate section of the plate-shaped piece into a tube body having a cavity enclosed by two opposite bottom walls and two opposite side walls, where a second plate section of the plate-shaped piece forms an extension portion on at least one side of the tube body, and the extension portion joins one bottom wall of the tube body.

This application further provides another processing method for a heat exchange tube, the processing method including:

preparing a plate-shaped piece; and bending a left end section of the plate-shaped piece multiple times to form a left through groove section having a plurality of through grooves, with openings of two adjacent through grooves of the left through groove section facing in opposite directions, and bending a right end section of the plate-shaped piece multiple times to form a right through groove section having a plurality of through grooves, with openings of two adjacent through grooves of the right through groove section facing in opposite directions, where there is a middle plate-shaped section between the left through groove section and the right through groove section, and the middle plate-shaped section includes a left plate section adjacent to the left through groove section, a middle plate section joining the left plate section, and a right plate section adjacent to the right through groove section;

folding the left through groove section toward the middle plate-shaped section, such that the left through groove section overlaps the left plate section, and a part of the left plate section blocks some through groove openings of the left through groove section; and folding the right through groove section toward the middle plate-shaped section, such that the right through groove section overlaps the right plate section, and a part of the right plate section blocks some through groove openings of the right through groove section;

refolding the left through groove section and the left plate section that overlap with each other toward the middle plate section, such that the left through groove section overlaps the middle plate section, a part of the middle plate section blocks the remaining through groove openings of the left through groove section, and a part of the left plate section that does not overlap the left through groove section overlaps the middle plate section; and refolding the right through groove section and the right plate section that overlap with each other toward the middle plate section, such that the right through groove section overlaps the middle plate section, a part of the middle plate section blocks the remaining through groove openings of the right through groove section, and a part of the right plate section that does not overlap the right through groove section overlaps the middle plate section, where after the folding, the right end of the left through groove section is adjacent to the left end of the right through groove section.

Because the heat exchange tube has the above technical effect, the corresponding processing method for the heat exchange tube also has a similar technical effect, and details will not be repeated herein.

DETAILED DESCRIPTION

Figure 1A:
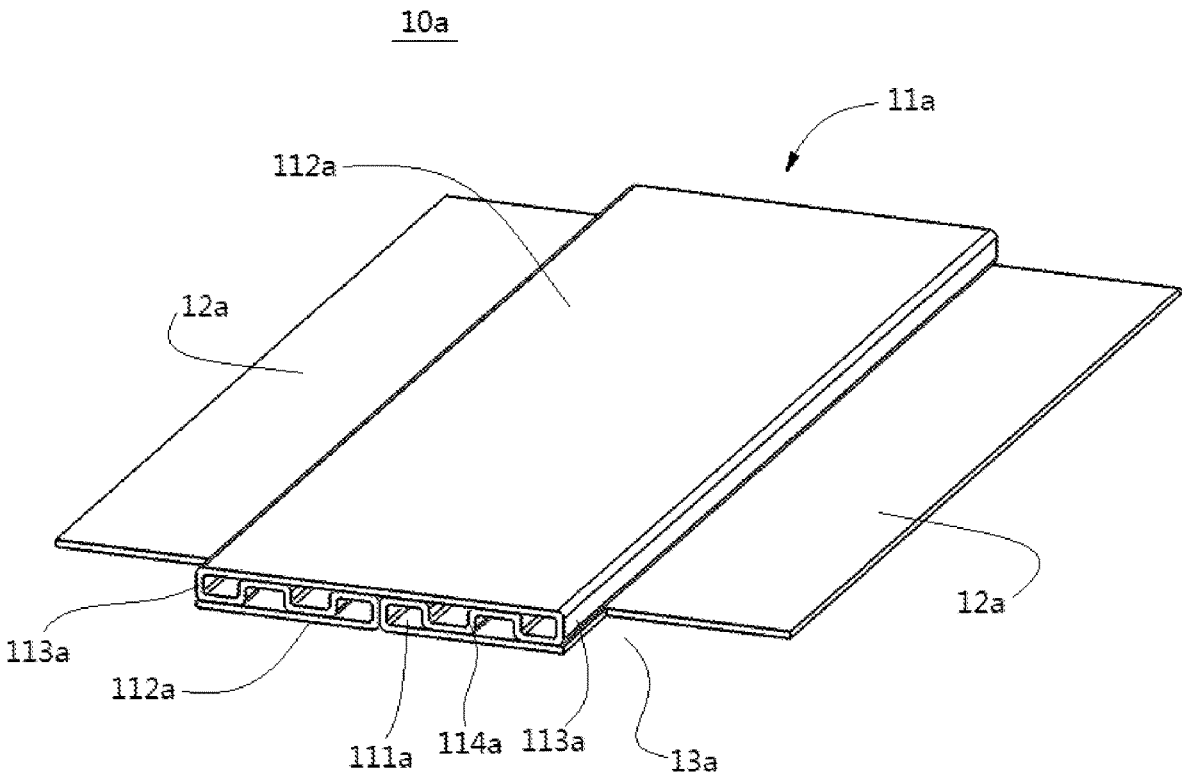
FIG. 1A is a schematic view of a heat exchange tube according an embodiment of the present disclosure.

A heat exchange tube provided in this application is applied to a heat exchanger, where the heat exchange tube includes a body portion having a plurality of flow channels arranged in parallel and spaced apart with each other, the length direction of each flow channel being parallel to the length direction of the body portion.

At least one side of the body portion is provided with an extension portion along the width direction of the body portion, where the extension portion and at least part of the body portion are formed by folding the same plate material.

The extension portion and the at least part of the body portion of the heat exchange tube are formed by folding the same plate material, such that the extension portion and the body portion do not need to be connected in an additional connection manner. This can increase a heat exchange area and improve heat exchange performance.

Specifically, the body portion includes tube walls, the tube walls enclose a tube body having a cavity, and at least part of the tube walls and the extension portion are formed by folding the same plate material.

More specifically, the tube walls include two bottom walls arranged in parallel and spaced apart, two opposite side walls are provided on both sides of the bottom walls, and the two bottom walls and the two side walls enclose the foregoing tube body, where at least one side of one bottom wall extends toward the outside of the tube body to form the extension portion, that is, the bottom wall and the extension portion are formed by the same plate material.

In a specific solution, the body portion is a flat tube structure, that is, the body portion is a flat structure with its thickness dimension being less than its width dimension.

Further, the length of the extension portion is less than the length of the body portion, such that a notch is formed between at least one end of the extension portion and one end of the body portion, that is, along the length direction, at least one end of the body portion protrudes from the extension portion. When the heat exchange tube is assembled with a header of the heat exchanger, the above-mentioned structural arrangement of the extension portion can help locate relative positions of the heat exchange tube and the header, that is, the part of the body portion of the heat exchange tube protruding from the extension portion is the depth for which the body portion is inserted into the header. In this way, the difficulty of assembling the heat exchange tube and the header can be reduced, thereby improving the assembly efficiency of the two. In addition, because a side of the body portion of the heat exchange tube is provided with an extension portion, after heat exchange tubes are assembled between two headers of the heat exchanger, the extension portion fills the space between adjacent body portions, which expands an heat transfer area, such that the heat transfer effect can be effectively improved.

A processing method for a heat exchange tube provided in this application includes:

preparing a plate-shaped piece;

folding a first plate section of the plate-shaped piece into a tube body having a cavity enclosed by two opposite bottom walls and two opposite side walls, where a second plate section of the plate-shaped piece forms an extension portion on at least one side of the tube body, and the extension portion joins one bottom wall of the tube body.

Further, when the first plate section of the plate-shaped piece is folded into the tube body, a part of the first plate section is bent to form an inner baffle separating the cavity into a plurality of flow channels.

To help those in the technical field better understand the solution of this application, this application will be further described in detail below with reference to the accompanying drawings and specific implementations.

Figure 1B:
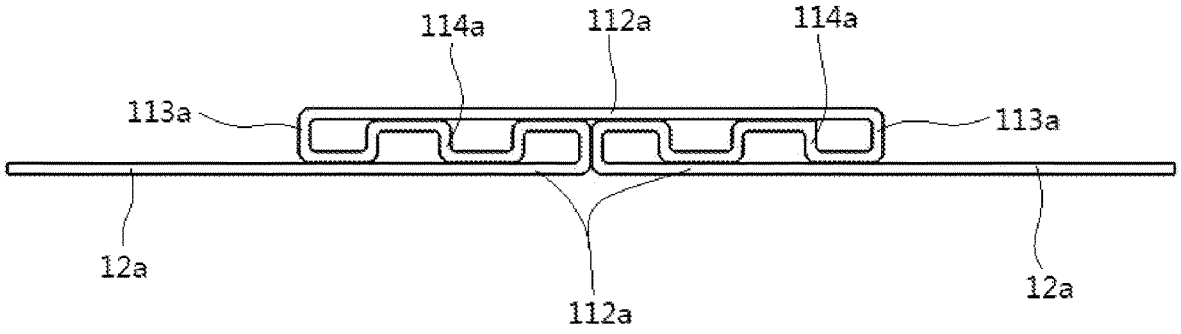
FIG. 1B is a front view of the heat exchange tube shown in FIG. 1A.

Referring to FIG. 1A and FIG. 1B, FIG. 1A is a schematic structural diagram of a first embodiment of a heat exchange tube according to this application, and FIG. 1B is a front view of the heat exchange tube shown in FIG. 1A.

In some embodiments, a heat exchange tube 10*a* includes a body portion 11*a*, the body portion 11*a* includes tube walls, and the tube walls enclose a tube body having a cavity. Specifically, the tube walls include two bottom walls 112*a* arranged in parallel and spaced apart, two opposite side walls 113*a* are provided on both sides of the bottom walls 112*a*, and the two bottom walls 112*a* and the two side walls 113*a* enclose the tube body.

The body portion 11*a* further includes an inner baffle 114*a* arranged in the cavity of the tube body, and the inner baffle 114*a* separates the cavity of the tube body into a plurality of flow channels 111*a*. As shown in FIG. 1A, the plurality of flow channels 111*a* are arranged in parallel and spaced apart from each other, where the length direction of each flow channel 111*a* is parallel to the length direction of the body portion 11*a*.

In some embodiments, along the width direction of the body portion 11*a*, both sides of the body portion 11*a* are provided with extension portions 12*a*.

Two sides of one bottom wall 112*a* of the body portion 11*a* each extend toward the outside of the tube body to form two extension portions 12*a*, and the thickness of the extension portion 12*a* is the same as that of the bottom wall 112*a*. In other words, the two extension portions 12*a* and the bottom wall 112*a* are formed by the same plate material. Specifically, the two extension portions 12*a* and the bottom wall 112*a* are in the same plane.

Specifically, the tube walls of the tube body of the body portion 11*a* are formed by folding the same plate material, that is, the two bottom walls 112*a* and the two side walls 113*a* are formed by folding the same plate material. Because the extension portions 12*a* and one bottom wall 112*a* are of the same plate material, the two bottom walls 112*a*, the two side walls 113*a*, and the two extension portions 12*a* are all formed by folding the same plate material.

Referring to FIG. 1A and FIG. 1B, for the inner baffle 114*a*, the same plate material is folded to form a plurality of baffle walls, so as to separate the cavity of the tube body to form the plurality of flow channels 111*a*.

Further, in some embodiments, the inner baffle 114*a*, the tube walls, and the extension portions 12*a* are all formed by folding the same plate material. In other words, the heat exchange tube 10*a* provided in some embodiments is formed by folding the same plate material. In this way, the heat exchange performance of the heat exchange tube 10*a* can be further improved.

Certainly, in practical arrangements, it is also feasible that the inner baffle 114*a* is formed by folding a separate plate material, the tube body and the extension portions 12*a* are formed by folding another plate material, and then the inner baffle 114*a* is fitted with the tube body.

Further, the length of the extension portion 12*a* is less than that of the body portion 11*a*, that is, along the length direction of the body portion 11*a*, at least one end of the body portion 11*a* protrudes from the extension portion 12*a*, and there is a preset distance between an end face of the extension portion 12*a* and a corresponding end face of the body portion 11*a*.

As shown in FIG. 1A, after such an arrangement is made, a notch 13*a* is formed between the end face of the body portion 11*a* and the end face of the extension portion 12*a*. During assembly, the part of the body portion 11*a* of the heat exchange tube 10*a* protruding from the extension portions 12*a* is inserted into a corresponding header, and the extension portions 12*a* form a locked stop relative to the header, such that locating of the heat exchange tube 10*a* and the header during assembly is implemented, which facilitates the assembly of the two.

From the orientation shown in FIG. 1A, the left-right direction is substantially the width direction of the body portion 11*a*, and the front-rear direction is substantially the length direction of the body portion 11*a*, where the notch 13*a* forms between the front end face of the body portion 11*a* and the front end face of the extension portion 12*a*. In the illustration, the rear end face of the body portion 11*a* and the rear end face of the extension portion 12*a* are not provided with a notch 13*a*. It can be understood that in practical applications, usually, both ends of the heat exchange tube 10*a* need to be inserted into and fitted with headers. In specific applications, material cutout may be performed on a corresponding part of the extension portion 12*a* as required, to form a structure similar to the notch 13*a* on the front side, thereby implementing the assembly locating of the heat exchange tube 10*a* and the header.

In some embodiments, the body portion 11*a* and the extension portions 12*a* of the heat exchange tube 10*a* are an integral structure. Specifically, the structure of the foregoing heat exchange tube 10*a* is formed by bending a plate-shaped piece, that is, the body portion 11*a* and the extension portions 12*a* are formed by bending the plate-shaped piece. In this way, the heat exchange tube 10*a* has no other external connection points in its own structure, and its strength can be ensured.

Referring to FIG. 2A to FIG. 2D, FIG. 2A to FIG. 2D are schematic diagrams of various procedures of a processing method for the heat exchange tube shown in FIG. 1A in a specific embodiment.

Figure 2A:
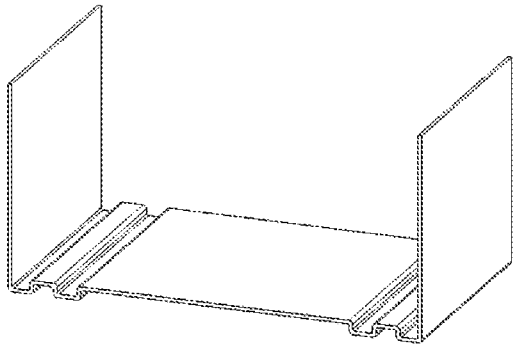
FIG. 2A to FIG. 2D are schematic view of processing method for the heat exchange tube in FIG. 1.
Figure 2B:
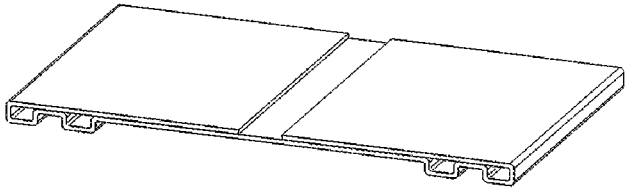
Figure 2C:
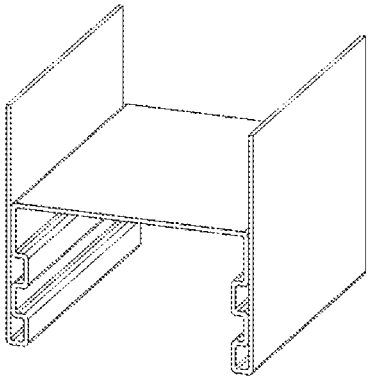
Figure 2D:
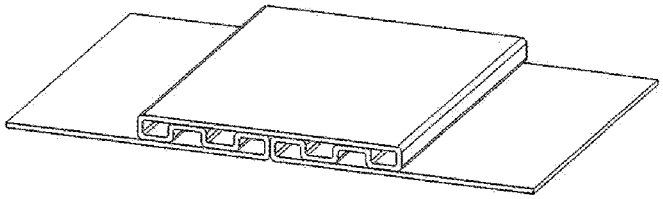

In a specific embodiment, the processing method in which the heat exchange tube 10*a* shown in FIG. 1A is formed by bending the plate-shaped piece is performed according to the following steps:

a. The plate-shaped piece is prepared.

b. As shown in FIG. 2A, from the orientation shown in the figure, the plate-shaped piece is bent multiple times at a position on the left of the plate-shaped piece (that is, a left partial plate section) to form a left through groove section. In the solution shown in the figure, the left through groove section has three through grooves, and openings of two adjacent through grooves face in opposite directions, where an opening of the through groove on the left faces upward, and there is a left plate-like section of a specific length on the left side of the left through groove section. The plate-shaped piece is bent multiple times at a position on the right of the plate-shaped piece (that is, a right partial plate section) to form a right through groove section. In the solution shown in the figure, the right through groove section also has three through grooves, and openings of two adjacent through grooves face in opposite directions, where an opening of the through groove on the right faces upward, and there is a right plate-like section of a specific length on the right side of the right through groove section. The left through groove section and the right through groove section are separated by a specific distance, forming a middle plate-shaped section therebetween.

c. As shown in FIG. 2B, the left plate-shaped section and the right plate-shaped section each are bent inward, that is, the left plate-shaped section and the right plate-shaped section are folded toward each other, such that a part of the left plate-shaped section covers the through grooves of the left through groove section and overlaps the middle plate-shaped section, and a part of the right plate-shaped section covers the through grooves of the right through groove section and overlaps the middle plate-shaped section.

d. As shown in FIG. 2C, the left part of the middle plate-shaped section is bent downward, such that the left plate-shaped section and the left through groove section that overlap with each other are bent together downward, and after the bending, part of the left plate-shaped section is located above the middle plate-shaped section; and the right part of the middle plate-shaped section is bent downward, such that the right plate-shaped section and the right through groove section that overlap with each other are bent together downward, and after the bending, part of the right plate-shaped section is located above the middle plate-shaped section.

e. As shown in FIG. 2D, the left plate-shaped section and the left through groove section that overlap with each other are then bent inward to overlap the left part of the unbent middle plate-shaped section, the right plate-shaped section and the right through groove section that overlap with each other are then bent inward to overlap the right part of the unbent middle plate-shaped section, and after the bending, the left through groove section abuts the right through groove section. It can be understood that after the bending, at this time, the positions of the left through groove section and the right through groove section are reversed by 180 degrees compared with those in FIG. 2A to FIG. 2D. From the orientation shown in FIG. 2D, the unbent middle plate-shaped section blocks through grooves with their openings facing upward of the left through groove section and the right through groove section in this state.

As shown in FIG. 2D, after the above-mentioned bending, the unbent middle plate-shaped section forms one bottom wall 112*a* of the tube body of the body portion 11*a*, and the part of the left plate-shaped section that overlap the left through groove section abuts the part of the right plate-shaped section that overlap the right through groove section to form the other bottom wall 112*a* of the tube body of the body portion 11*a*; the left through groove section and the right through groove section form the inner baffle 114*a* of the body portion 11*a*; the left through groove section, the right through groove section, a part of the left plate-shaped section that blocks openings of the left through groove section, a part of the right plate-shaped section that blocks openings of the right through groove section, and the part of the middle plate-shaped section that blocks the openings of the left through groove section and the right through groove section form the body portion 11*a* of the heat exchange tube 10*a*, and the through grooves with their openings being blocked after the bending form the flow channels 111*a* of the body portion 11*a*; and at the same time, after the above-mentioned bending, the part of the left plate-shaped section above the middle plate-shaped section in step 2*d* forms the extension portion 12*a* on the left of the body section 11*a*, and the part of the right plate-shaped section above the middle plate-shaped section in step 2*d* forms the extension portion 12*a* on the right of the body section 11*a*.

f. Material cutout is performed on the two extension portions 12*a* in step 2*e* as required, such that two ends of the body portion 11*a* along the length direction protrude from the extension portions 12*a* by a preset distance.

In the foregoing processing method for the heat exchange tube 10*a*, the plate-shaped piece is folded in the form of a square wave to form side walls of the flow channels 111*a* of the heat exchange tube 10*a*. As such, the cross section of the flow channel 111*a* of the heat exchange tube 10*a* formed by processing is a square structure. It can be understood with reference to FIG. 1A, FIG. 1B, and FIG. 2D that after the folding, one of the top wall or the bottom wall of the flow channel 111*a* of the heat exchange tube 10*a* is a double-layer plate structure, and the other is a single-layer plate structure.

The extension portion 12*a* of the heat exchange tube 10*a* formed by processing using the foregoing method is a single-layer plate structure, that is, the wall thickness of the extension portion 12*a* is the same as that of the tube wall of the body portion 11*a*. It can be understood that, in practical arrangements, the extension portion 12*a* may also be a double-layer plate structure or a plate structure of at least three layers. Specifically, after the foregoing step e, the plate structures on both sides of the body portion 11*a* may be refolded to form extension portions with double-layer structures, or may be folded multiple times to form extension portions with plate structures of at least three layers.

It should be noted that the foregoing description is merely an example of a processing method for forming the heat exchange tube 10*a* shown in FIG. 1A and FIG. 1B. It can be understood that, in practice, the processing steps of the heat exchange tube 10*a* are not limited to the foregoing description, provided that the structure of the heat exchange tube 10*a* can be formed by folding the plate-shaped piece.

Figure 3:
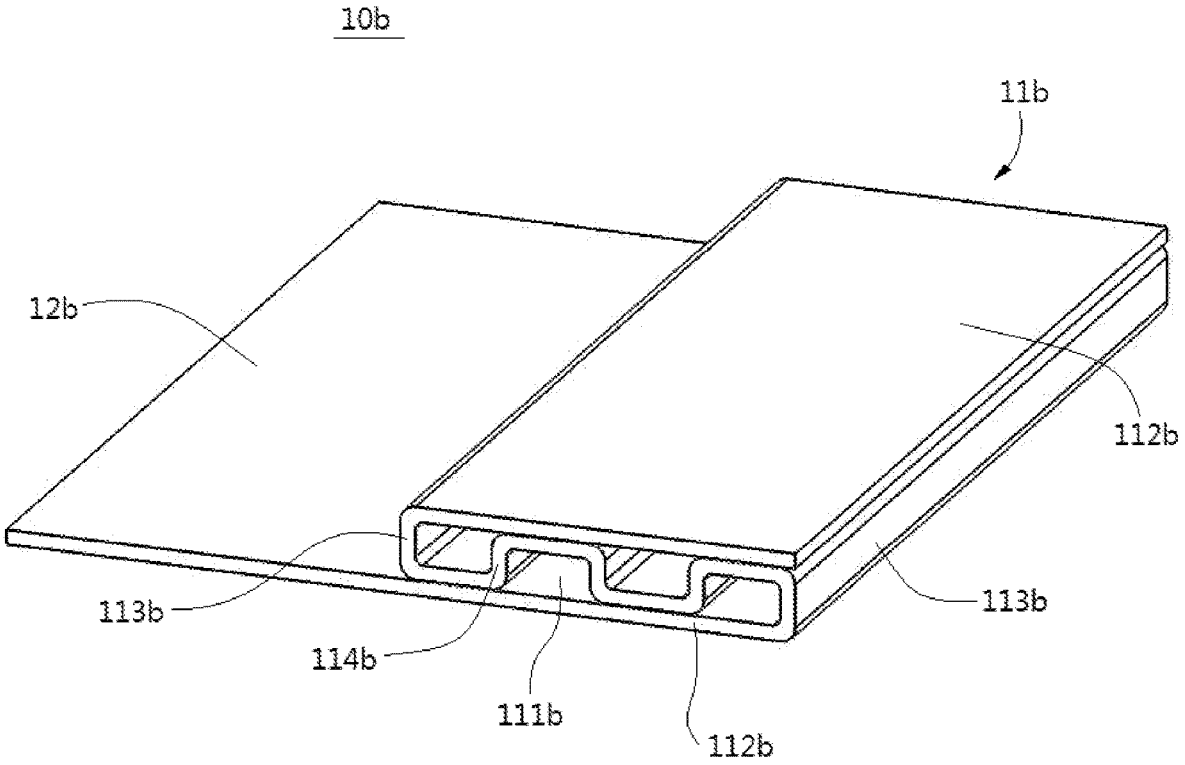
FIG. 3 is a schematic view of a heat exchange tube according an embodiment of the present disclosure.
Figure 4:
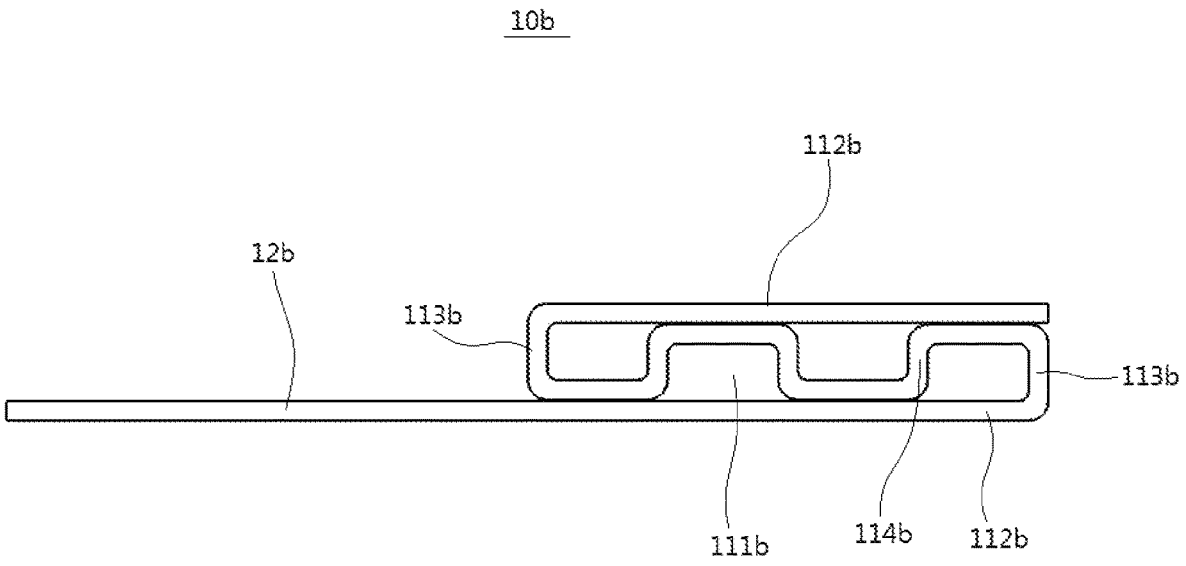
FIG. 4 is a front view of the heat exchange tube in FIG. 3.

Referring to FIG. 3 and FIG. 4, FIG. 3 is a schematic structural diagram of a second embodiment of a heat exchange tube according to this application, and FIG. 4 is a front view of the heat exchange tube shown in FIG. 3.

In some embodiments, a heat exchange tube 10*b* includes a body portion 11*b*, the body portion 11*b* includes a tube body having a cavity, and the tube body is enclosed by tube walls. Specifically, the tube walls include two bottom walls 112*b* arranged in parallel and spaced apart, two opposite side walls 113*b* are provided on both sides of the bottom walls 112*b*, and the two bottom walls 112*b* and the two side walls 113*b* enclose the tube body. The body portion 11*b* further includes an inner baffle 114*b* arranged in the cavity of the tube body, and the inner baffle 114*b* separates the cavity of the tube body into a plurality of flow channels 111*b* arranged in parallel and spaced apart from each other, where the length direction of each flow channel 111*b* is parallel to the length direction of the body portion 11*b*.

Along the width direction of the body portion 11*b*, one side of one bottom wall 112*b* of the body portion 11*b* extends outward to form an extension portion 12*b*. In the illustration, the extension portion 12*b* is provided on the left of the body portion 11*b*. Specifically, the extension portion 12*b* and the bottom wall 112*b* are in the same plane.

In some embodiments, the inner baffle 114*b* of the body portion 11*b* presents a square-wave bent structure, a shape of the cross section of each flow channel 111*b* formed by separating the cavity of the tube body is square, and the extension portion 12*b* is a single-layer plate structure, that is, the thickness of the extension portion 12*b* is the same as the thickness of the bottom wall 112*b* of the tube body.

In some embodiments, one side of one bottom wall 112*b* extends toward the outside of the tube body to form the extension portion 12*b*, and the tube walls, the extension portion 12*b*, and the inner baffle 114*b* forming the tube body are all formed by folding the same plate material.

In some embodiments, the extension portion 12*b* is provided only on one side of the body portion 11*b*. Therefore, the heat exchange tube 10*b* provided in some embodiments requires fewer procedures during processing.

In brief, processing steps of a processing method for the heat exchange tube 10*b* are as follows:

preparing a plate-shaped piece;

bending the plate-shaped piece back and forth at appropriate positions to form a through groove bent section having a plurality of through grooves, where in the through groove bent section, openings of two adjacent through grooves face in opposite directions, and a first plate-shaped section and a second plate-shaped section are reserved on both sides of the through groove bent section; and folding the first plate-shaped section upward to block through grooves of the through groove bent section with their openings facing upward, and folding the second plate-shaped section downward to block through grooves of the through groove bent section with their openings facing downward, where after being bent, the second plate-shaped section further has an extension section extending toward one side of the through groove bent section, such that the through groove bent section, the first plate-shaped section, and a part of the second plate-shaped section that blocks the through groove bent section form the body portion 11*b* of the heat exchange tube 10*b*.

Specifically, material cutout may be performed on the part of the second plate-shaped section that extends out of the through groove bent section, to form the extension portion 12*b*, such that two ends of the body portion 11*b* protrude from the extension portion 12*b*, to facilitate locating during the assembly with headers.

It can be learned that the processing method for the heat exchange tube 10*b* is simpler than the processing method for the heat exchange tube 10*a* of Embodiment 1. In practice, the structure of the heat exchange tube can be determined as required.

Figure 5:
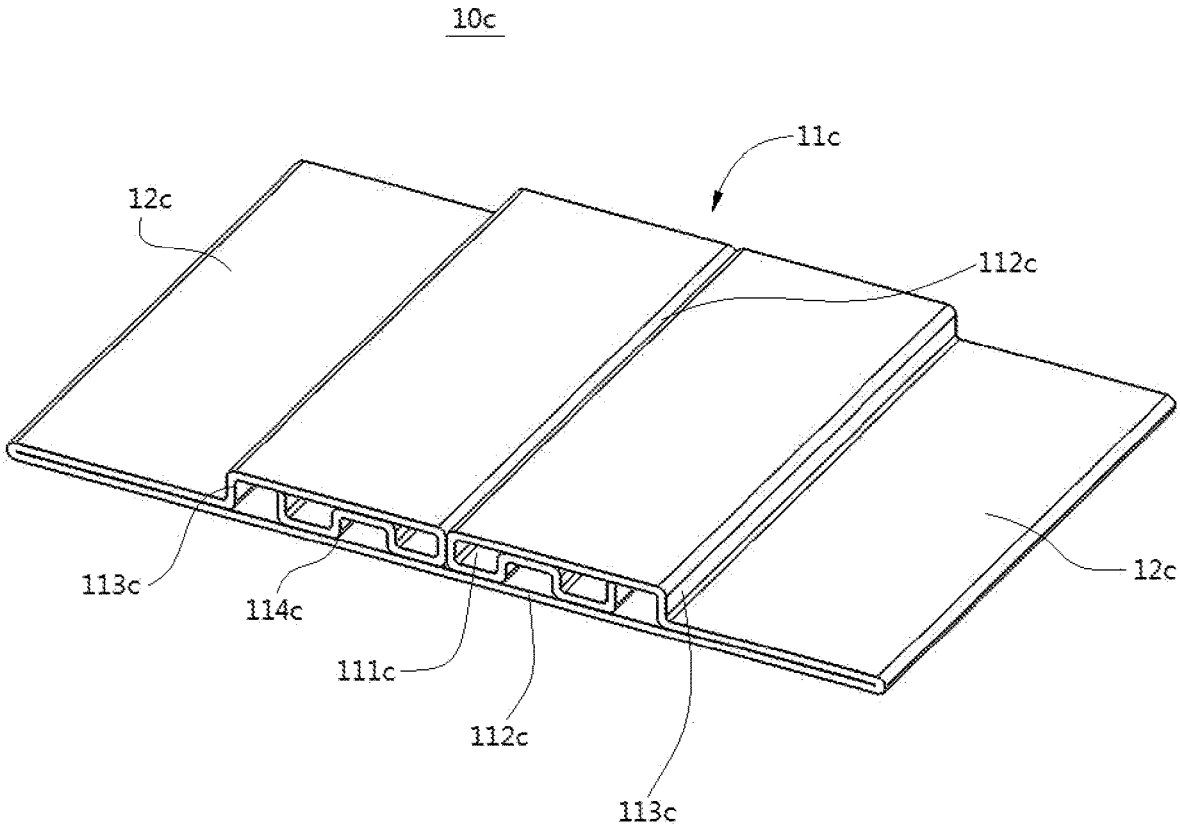
FIG. 5 is a schematic view of a heat exchange tube according an embodiment of the present disclosure.
Figure 6:
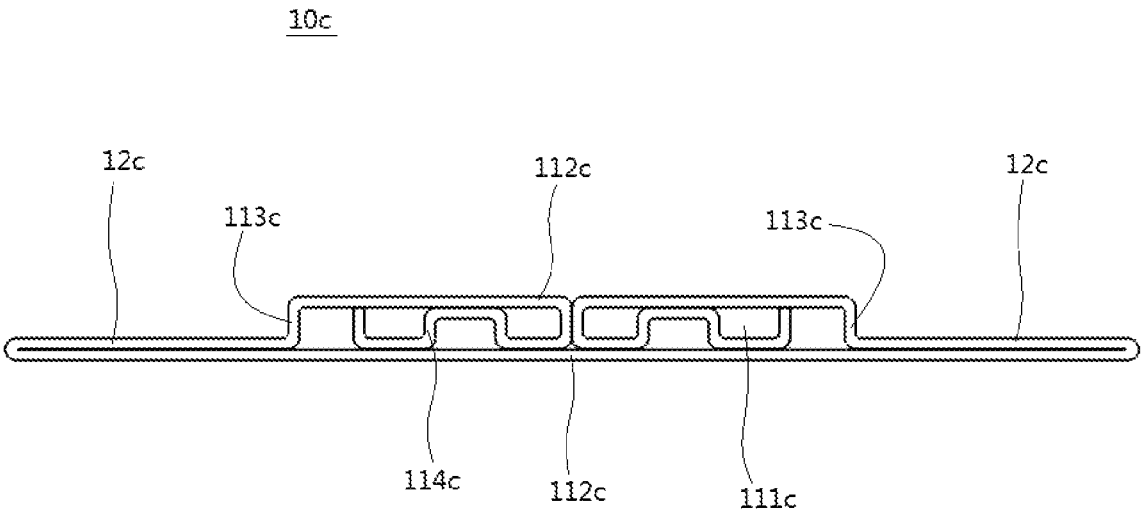
FIG. 6 is a front view of the heat exchange tube in FIG. 5.

Referring to FIG. 5 and FIG. 6, FIG. 5 is a schematic structural diagram of a third embodiment of a heat exchange tube according to this application, and FIG. 6 is a front view of the heat exchange tube shown in FIG. 5.

In some embodiments, a heat exchange tube 10*c* includes a body portion 11*c*, the body portion 11*c* includes a tube body having a cavity, and the tube body is enclosed by tube walls. Specifically, the tube walls include two bottom walls 112*c* arranged in parallel and spaced apart, two opposite side walls 113*c* are provided on both sides of the bottom walls 112*c*, and the two bottom walls 112*c* and the two side walls 113*c* enclose the tube body. The body portion 11*c* further includes an inner baffle 114*c* arranged in the cavity of the tube body, and the inner baffle 114*c* separates the cavity of the tube body into a plurality of flow channels 111*c* arranged in parallel and spaced apart from each other, where the length direction of each flow channel 111*c* is parallel to the length direction of the body portion 11*c*.

Along the width direction of the body portion 11*c*, both sides of the body portion 11*c* extend outward to form extension portions 12*c*.

In some embodiments, the inner baffle 114*c* of the body portion 11*c* also presents a square-wave bent structure, and a shape of the cross section of each flow channel 111*c* formed by separating the cavity of the tube body is also square.

In some embodiments, the tube walls, the extension portions 12*c*, and the inner baffle 114*c* forming the tube body are all formed by folding the same plate material.

The extension portion 12*c* is a double-layer plate structure, that is, the thickness of the extension portion 12*c* is twice that of the tube wall. Specifically, referring to FIG. 5 and FIG. 6, the extension portion 12*c* includes two layers of plate material portions that are stacked. The outer ends of the two plate material portions join together. The inner end of one of the two plate material portions joins one bottom wall 112*c*, and the inner end of the other joins the side wall 113*c*.

Specifically, the extension portion 12*c* and the bottom wall 112*c* that joins the extension portion 12*c* are in the same plane.

Specifically, it can be understood that one end of one side wall 113*c* is bent outward and extends a specific length to form one plate portion of the extension portion 12*c*; after being folded, extends inward the same length to form the other plate portion of the extension portion 12*c*; and continues to extend inward to form one bottom wall 112*c* of the tube body.

Compared with Embodiment 1 described above, the heat exchange tube 10*c* provided in this embodiment differs that the extension portion 12*c* is a double-layer plate structure.

With reference to FIG. 5 and FIG. 6, it can be understood that the manner of bending the plate-shaped piece to form the heat exchange tube 10*c* is simply bending the two ends of the plate-shaped piece inward, and folding parts at the two ends to abut to form the body portion 11*c*. From the orientation shown in FIG. 6, the lower bottom wall 112*c* of the body portion 11*c* and the extension portions 12*c* on both sides are formed by folding the same plate material, and the upper bottom wall 112*c* of the body portion 11*c* is formed by abutting the two parts of the plate-shaped piece.

In brief, processing steps of a processing method for the heat exchange tube 10*c* are as follows:

preparing a plate-shaped piece;

bending a left end section of the plate-shaped piece multiple times to form a left through groove section having a plurality of through grooves, with openings of two adjacent through grooves of the left through groove section facing in opposite directions, and bending a right end section of the plate-shaped piece multiple times to form a right through groove section having a plurality of through grooves, with openings of two adjacent through grooves of the right through groove section facing in opposite directions, where there is a middle plate-shaped section between the left through groove section and the right through groove section, and the middle plate-shaped section includes a left plate section adjacent to the left through groove section, a middle plate section joining the left plate section, and a right plate section adjacent to the right through groove section;

folding the left through groove section toward the middle plate-shaped section, such that the left through groove section overlaps the left plate section, and a part of the left plate section blocks some through groove openings of the left through groove section; and folding the right through groove section toward the middle plate-shaped section, such that the right through groove section overlaps the right plate section, and a part of the right plate section blocks some through groove openings of the right through groove section;

refolding the left through groove section and the left plate section that overlap with each other toward the middle plate section, such that the left through groove section overlaps the middle plate section, a part of the middle plate section blocks the remaining through groove openings of the left through groove section, and a part of the left plate section that does not overlap the left through groove section overlaps the middle plate section; and refolding the right through groove section and the right plate section that overlap with each other toward the middle plate section, such that the right through groove section overlaps the middle plate section, a part of the middle plate section blocks the remaining through groove openings of the right through groove section, and a part of the right plate section that does not overlap the right through groove section overlaps the middle plate section, where after the folding, the right end of the left through groove section is adjacent to the left end of the right through groove section.

Certainly, on the basis of the structure of the heat exchange tube shown in FIG. 1A, the extension portions thereof may be folded upward to form a heat exchange tube structure similar to that shown in FIG. 5 and FIG. 6. In other words, there may be many manners of forming the heat exchange tube 10*c* by bending the plate-shaped piece.

Figure 7:
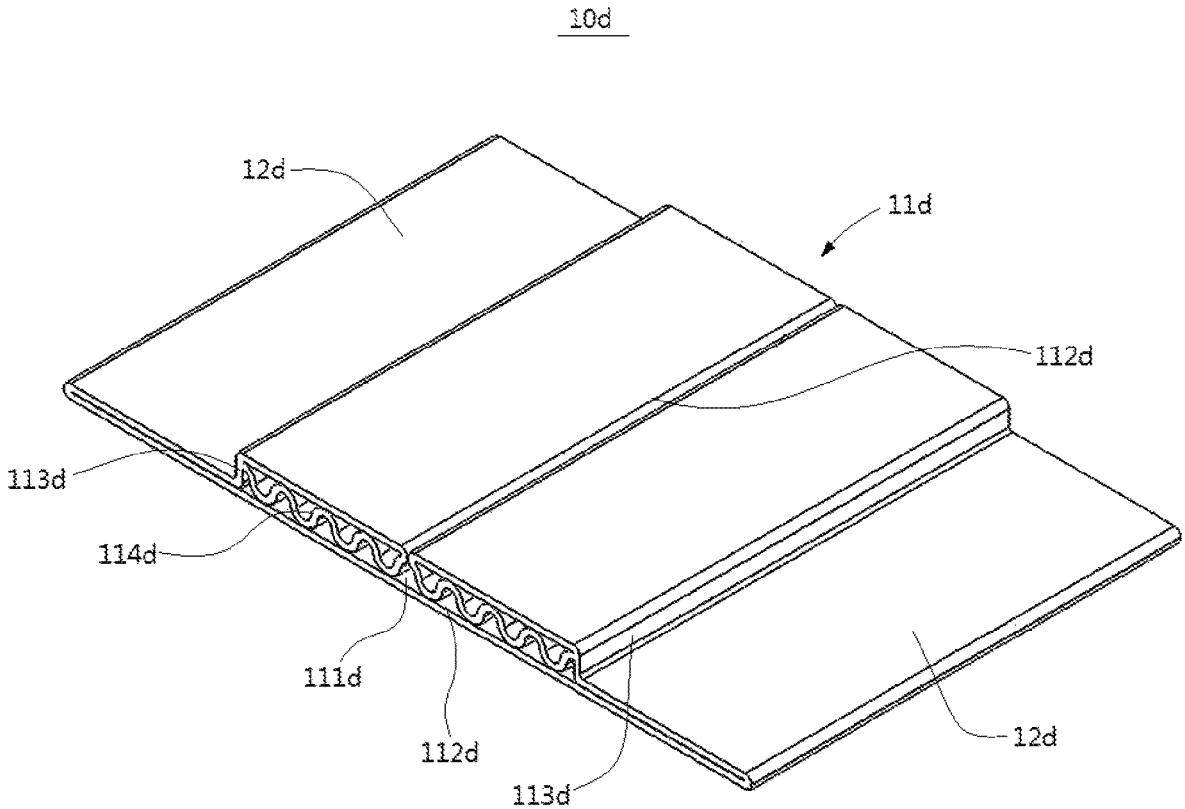
FIG. 7 is a schematic view of a heat exchange tube according an embodiment of the present disclosure.
Figure 8:
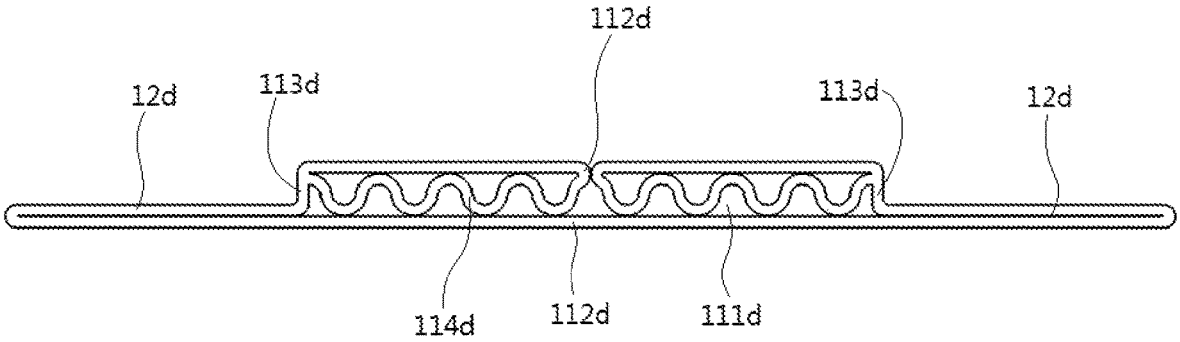
FIG. 8 is a front view of the heat exchange tube in FIG. 7.

Referring to FIG. 7 and FIG. 8, FIG. 7 is a schematic structural diagram of a fourth embodiment of a heat exchange tube according to this application, and FIG. 8 is a front view of the heat exchange tube shown in FIG. 7.

In some embodiments, a heat exchange tube 10*d* includes a body portion 11*d*, the body portion 11*d* includes tube walls, and the tube walls enclose a tube body having a cavity. Specifically, the tube walls include two bottom walls 112*d* arranged in parallel and spaced apart, two opposite side walls 113*d* are provided on both sides of the bottom walls 112*d*, and the two bottom walls 112*d* and the two side walls 113*d* enclose the tube body. The body portion 11*d* further includes an inner baffle 114*d* arranged in the cavity of the tube body, and the inner baffle 114*d* separates the cavity of the tube body into a plurality of flow channels 111*d* arranged in parallel and spaced apart from each other, where the length direction of each flow channel 111*d* is parallel to the length direction of the body portion 11*d*.

Along the width direction of the body portion 11*d*, both sides of the body portion 11*d* extend outward to form extension portions 12*d*.

In some embodiments, the tube walls, the extension portions 12*d*, and the inner baffle 114*d* forming the tube body are all formed by folding the same plate material.

In some embodiments, the two extension portions 12*d* of the body portion 11*d* are both double-layer plate structures, that is, the thickness of the extension portion 12*d* is twice that of the tube wall. Specifically, referring to FIG. 7 and FIG. 8, the extension portion 12*d* includes two layers of plate material portions that are stacked. The outer ends of the two plate material portions join together. The inner end of one of the two plate material portions joins one bottom wall 112*d*, and the inner end of the other joins the side wall 113*d*.

Specifically, the extension portion 12*d* and the bottom wall 112*d* that joins the extension portion 12*d* are in the same plane.

Specifically, in this embodiment, the folding manner of the plate material is similar to that of Embodiment 3 described above. Compared with Embodiment 3 described above, the heat exchange tube 10*d* provided in this embodiment differs in that a shape of the cross section of the flow channel 111*d* is different. In this embodiment, the structure of the inner baffle 114*d* is different, and the inner baffle 114*d* is bent in the form of a sine wave.

Similarly, in other solutions, the inner baffle 114*d* may alternatively be bent in a wave shape, provided that the cavity of the tube body can be separated into a plurality of flow channels 111*d* arranged in parallel to each other.

Figure 9:
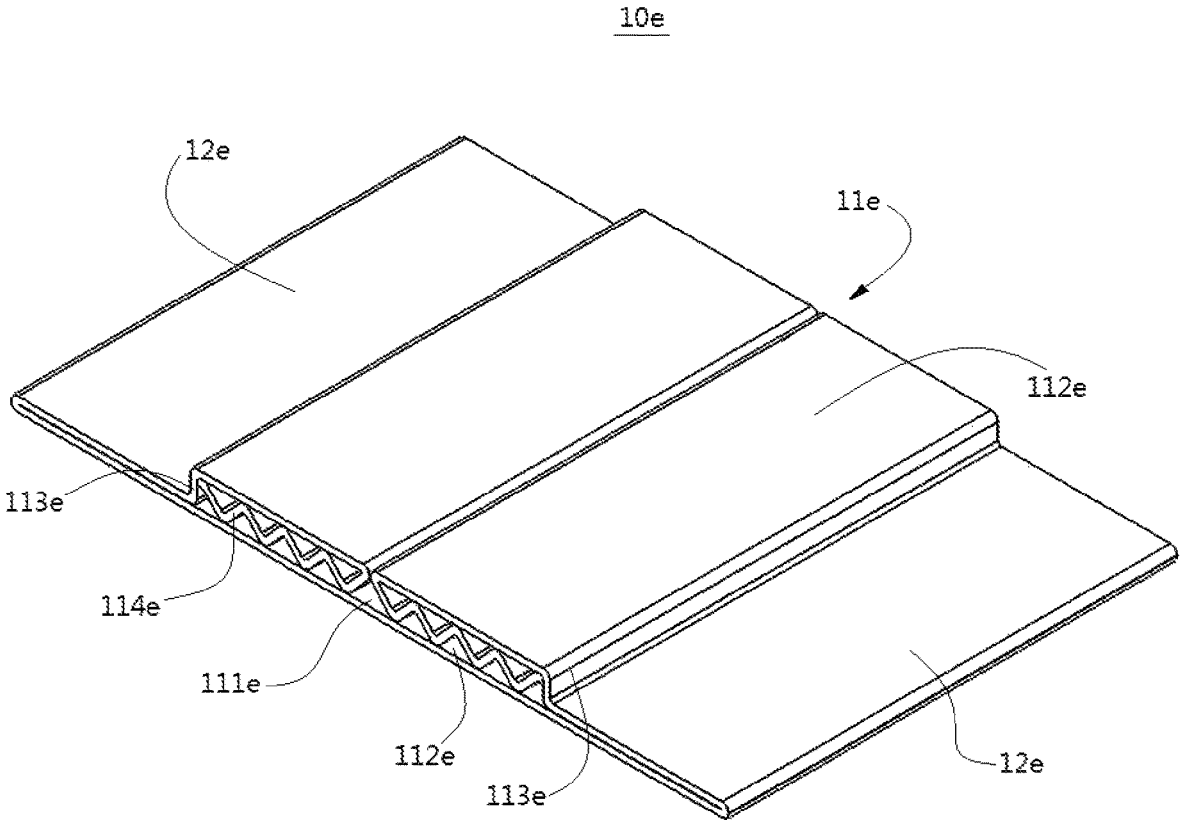
FIG. 9 is a schematic view of a heat exchange tube according an embodiment of the present disclosure.
Figure 10:
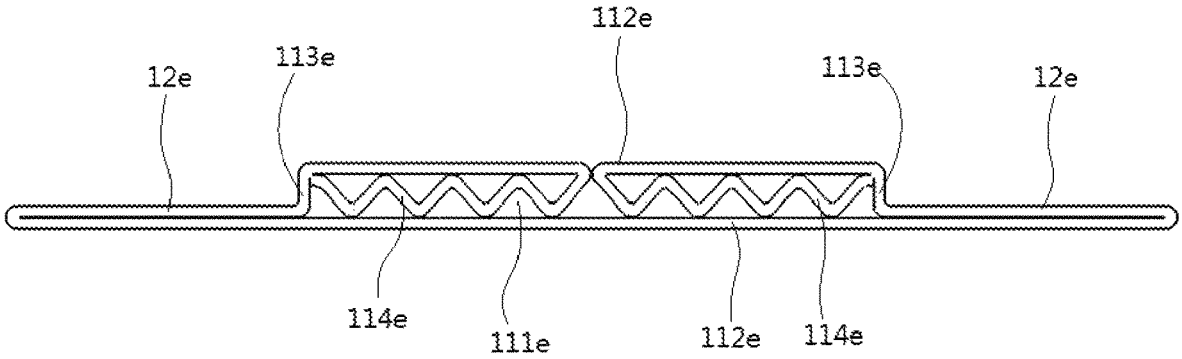
FIG. 10 is a front view of the heat exchange tube in FIG. 9.

Referring to FIG. 9 and FIG. 10, FIG. 9 is a schematic structural diagram of a fifth embodiment of a heat exchange tube according to this application, and FIG. 10 is a front view of the heat exchange tube shown in FIG. 9.

In some embodiments, a heat exchange tube 10*e* includes a body portion 11*e*, the body portion 11*e* includes tube walls, and the tube walls enclose a tube body having a cavity. Specifically, the tube walls include two bottom walls 112*e* arranged in parallel and spaced apart, two opposite side walls 113*e* are provided on both sides of the bottom walls 112*e*, and the two bottom walls 112*e* and the two side walls 113*e* enclose the tube body. The body portion 11*e* further includes an inner baffle 114*e* arranged in the cavity of the tube body, and the inner baffle 114*e* separates the cavity of the tube body into a plurality of flow channels 111*e* arranged in parallel and spaced apart from each other, where the length direction of each flow channel 111*e* is parallel to the length direction of the body portion 11*e*.

Along the width direction of the body portion 11*e*, both sides of the body portion 11*e* are provided with extension portions 12*e*.

In some embodiments, the tube walls, the extension portions 12*e*, and the inner baffle 114*e* forming the tube body are all formed by folding the same plate material.

In some embodiments, the two extension portions 12*e* of the body portion 11*e* are both double-layer plate structures, that is, the thickness of the extension portion 12*e* is twice that of the tube wall. Specifically, referring to FIG. 9 and FIG. 10, the extension portion 12*e* includes two layers of plate material portions that are stacked. The outer ends of the two plate material portions join together. The inner end of one of the two plate material portions joins one bottom wall 112*e*, and the inner end of the other joins the side wall 113*e*.

Specifically, the extension portion 12*e* and the bottom wall 112*e* that joins the extension portion 12*e* are in the same plane.

Specifically, in some embodiments, the folding manner of the plate material is similar to that of Embodiment 3 described above. Compared with Embodiment 3 described above, the heat exchange tube 10*e* provided in some embodiments differs in that a shape of the cross section of the flow channel 111*e* is different. In some embodiments, the structure of the inner baffle 114*e* is different. Specifically, the inner baffle 114*e* is bent in the form of a triangular wave, and the cross section of each flow channel 111*e* formed by separating the cavity of the tube body presents a triangular structure.

The foregoing lists the specific structures of several heat exchange tubes in an exemplary manner. It can be understood that, in practice, when the overall structure of the heat exchange tube remains unchanged, its specific structure may change due to different folding manners.

In addition, in practical arrangements, the shape of the cross section of each flow channel of the body portion of the heat exchange tube can also be varying. To be specific, in the process of manufacturing the heat exchange tube, different side-wall section structures of the flow channels may be formed by folding manners in different shapes, such as a combination of square wave folding and sine wave folding, or a combination of sine wave folding and triangular wave folding.

In addition, it can be understood that when there are extension portions on both sides of the body portion of the heat exchange tube, structures of the two extension portions may also be set differently. For example, the extension portion on one side is a single-layer plate structure, and the extension portion on the other side is a double-layer plate structure. Certainly, in addition to the single-layer or double-layer plate structure, the extension portion may also be folded repeatedly to form a multi-layer plate structure of at least three layers.

It should be noted that in some embodiments, in the illustrated solutions corresponding to the embodiments, the length of the extension portion is the same as that of the body portion. It can be understood that in practical arrangements, material cutout may be performed on one or two ends of the extension portion as required, such that the end of the body portion protrudes from the extension portion by a predetermined distance, to limit relative mounting positions of the heat exchange tube and the header when the heat exchange tube is inserted into and fitted with the header.

In addition to the foregoing heat exchange tube, this application further provides a heat exchanger including two headers arranged in parallel and spaced apart, between which there are arranged a plurality of heat exchange tubes, with the width direction of the heat exchange tube being parallel to the length direction of the header, where the heat exchange tube are in communication with the two headers through its body portion.

Figure 11:
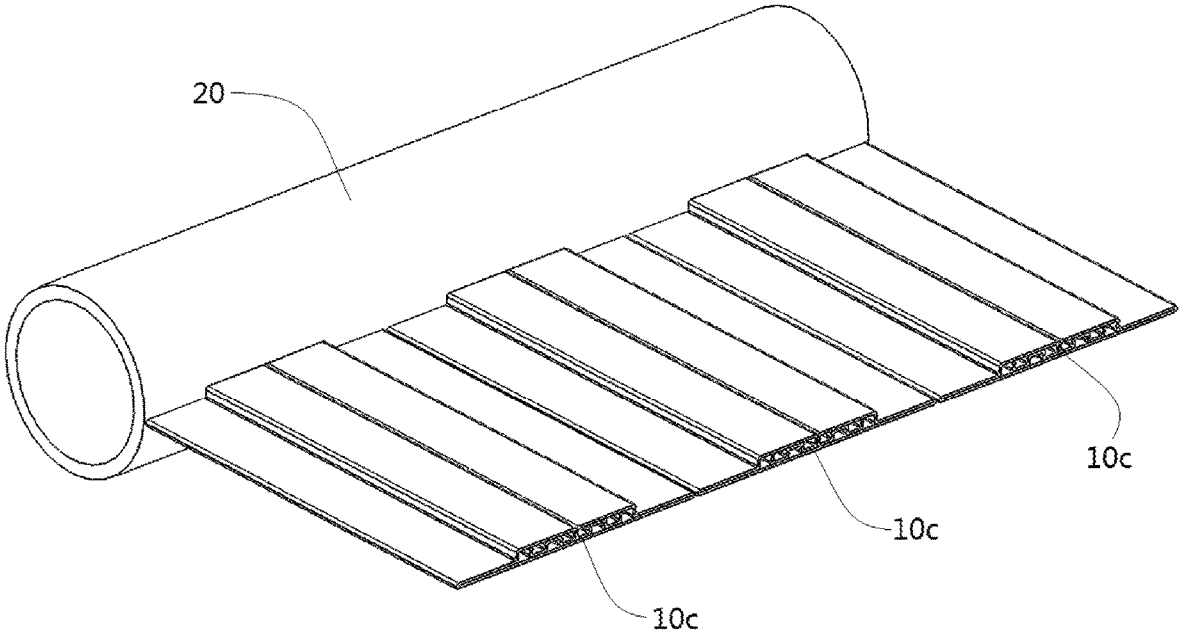
FIG. 11 is a schematic view of the heat exchange tube in FIG. 5 being connected to a header.
Figure 12:
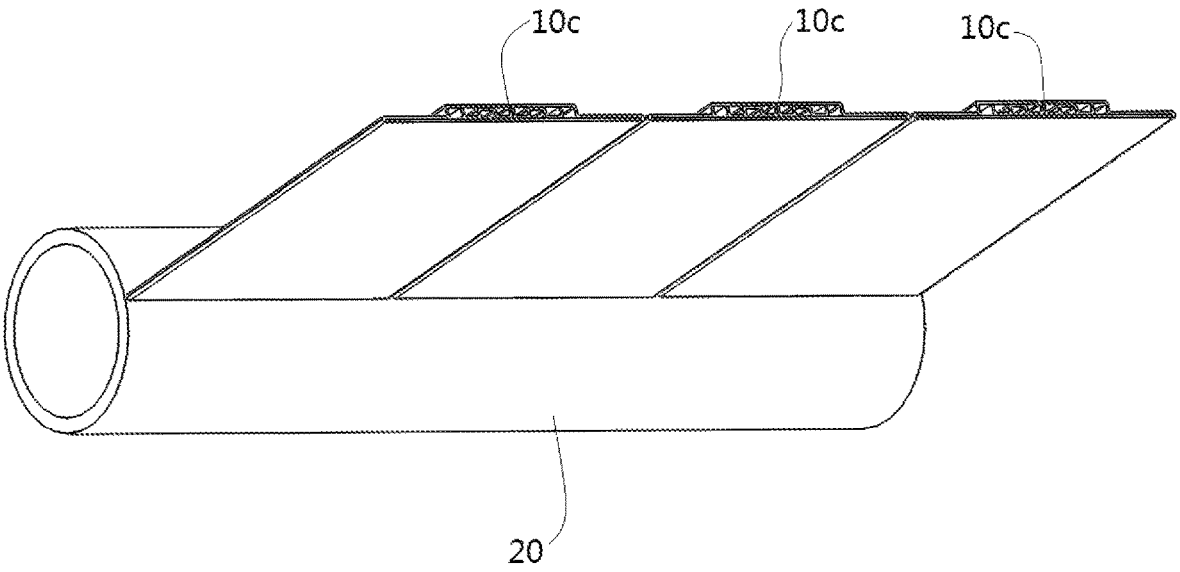
FIG. 12 is a schematic view shown from another angle of the heat exchange tube and the header in FIG. 11

Referring to FIG. 11 and FIG. 12, FIG. 11 is a schematic structural diagram of the heat exchange tube shown in FIG. 5 being connected to a header, and FIG. 12 is a schematic structural diagram, from another perspective, of the heat exchange tube and the header shown in FIG. 11.

FIG. 11 and FIG. 12 exemplarily show a connection structure of the heat exchange tubes 10*c* and one header 20.

As shown in FIG. 11 and FIG. 12, in a specific solution, two adjacent heat exchange tubes 10*c* are arranged in contact with each other along the length direction of the header 20. In the illustrated solution, both sides of the body portion of the heat exchange tube 10*c* are provided with extension portions. As such, the two adjacent heat exchange tubes 10*c* being arranged in contact with each other means that a space between an extension portion on one side of one heat exchange tube 10*c* and an extension portion on the corresponding side of another adjacent heat exchange tube 10*c* is zero. For the heat exchanger formed in such a way, a space between two headers 20 is completely filled by the heat exchange tubes 10*c*, and due to the design of the extension portion 12*c* of the heat exchange tube 10*c*, slots on the header 20 that fit with the heat exchange tubes 10*c* are distributed at intervals, such that the strength of the header 20 can be ensured, and a heat exchange area of the heat exchanger is also increased, improving the heat exchange efficiency.

It can be understood that when the heat exchange tubes connected between the two headers 20 each are provided with an extension portion only on one side, two adjacent heat exchange tubes are still arranged in contact with each other. In this case, the two adjacent heat exchange tubes being in contact with each other means that a space between an extension portion on one side of one heat exchange tube and a body portion of another heat exchange tube is zero.

Specifically, among the plurality of heat exchange tubes connected between the two headers of the heat exchanger, at least two heat exchange tubes are in the same plane.

It should also be noted herein that "same" mentioned throughout this specification does not mean simply "absolutely same" in the mathematical sense, but a certain range of errors is allowed.

The heat exchange tube, the processing method for same, and the heat exchanger having same provided in this application are all described in detail above. Specific examples are used in this specification to explain the principle and implementations of this application. The description of the foregoing embodiments is only used to help understand the method and core idea of this application. It should be noted that for those of ordinary skill in the art, some improvements and modifications can also be made to this application without departing from the principle of the present invention, and such improvements and modifications also fall within the scope of protection of this application.

The invention claimed is:

1. A heat exchange tube for a heat exchanger, comprising:

a body portion including a plurality of flow channels arranged in parallel and spaced apart from each other, a length direction of the flow channels being parallel to a length direction of the body portion; and an extension portion extending from at least one side of the body portion along a width direction of the body portion, wherein the extension portion and at least a part of the body portion are formed by folding a same plate material, wherein the extension portion comprises two stacked plate material portions, outer ends of the two stacked plate material portions join together, an inner end of one of the two stacked plate material portions joins a bottom wall of the body portion, and an inner end of the other of the two stacked plate material portions joins a side wall of the body portion, and wherein the body portion and the extension portion of the heat exchange tube are an integral structure.

2. The heat exchange tube according to claim 1, wherein the body portion comprises tube walls enclosing a tube body having a cavity.

3. The heat exchange tube according to claim 2, wherein the tube walls comprise two bottom walls arranged in parallel and spaced apart, and two opposite side walls disposed on both sides of the bottom walls, and wherein the two bottom walls and the two side walls enclose the tube body.

4. The heat exchange tube according to claim 3, wherein a length of each of the side walls is less than a length of each of the bottom walls in a cross section of the body portion along the width direction.

5. The heat exchange tube according to claim 3, wherein at least one side of one bottom wall extends toward an outside of the tube body and then is folded to form the extension portion, and a thickness of at least a part of the extension portion is at least two times that of the bottom wall.

6. The heat exchange tube according to claim 3, wherein the extension portion and one bottom wall are in a same plane.

7. The heat exchange tube according to claim 2, wherein the body portion further comprises an inner baffle arranged in the cavity, the inner baffle separates the cavity into the plurality of flow channels, and the tube walls, the extension portion, and the inner baffle are formed by bending the same plate material.

8. The heat exchange tube according to claim 1, wherein a length of the extension portion is less than a length of the body portion.

9. A heat exchanger comprising two headers arranged in parallel and spaced apart, between which a plurality of heat exchange tubes are arranged, with a width direction of the heat exchange tubes being parallel to a length direction of the headers, wherein each of the plurality of heat exchange tubes comprises:

a body portion including a plurality of flow channels arranged in parallel and spaced apart from each other, a length direction of the flow channels being parallel to a length direction of the body portion; and an extension portion extending from at least one side of the body portion along a width direction of the body portion, wherein the extension portion and at least a part of the body portion are formed by folding a same plate material, wherein the plurality of heat exchange tubes are in communication with the two headers through the body portion, wherein the extension portion comprises two stacked plate material portions, outer ends of the two stacked plate material portions join together, an inner end of one of the two stacked plate material portions joins a bottom wall of the body portion, and an inner end of the other of the two stacked plate material portions joins a side wall of the body portion, and wherein the body portion and the extension portion of the respective heat exchange tube are an integral structure.

10. The heat exchanger according to claim 9, wherein along the length direction of the headers, a space between the extension portions of at least two adjacent heat exchange tubes is zero, or a space between the extension portion of at least one heat exchange tube and the body portion of an adjacent heat exchange tube is zero.

11. The heat exchanger according to claim 9, wherein two or more heat exchange tubes are in a same plane along the length direction of the headers.

12. The heat exchanger according to claim 9, wherein the extension portion and one bottom wall are in a same plane.

13. A processing method for a heat exchange tube, comprising:

preparing a plate-shaped piece; and bending a left end section of the plate-shaped piece multiple times to form a left through groove section having a plurality of through grooves, with openings of two adjacent through grooves of the left through groove section facing in opposite directions, and bending a right end section of the plate-shaped piece multiple times to form a right through groove section having a plurality of through grooves, with openings of two adjacent through grooves of the right through groove section facing in opposite directions, such that a middle plate-shaped section is disposed between the left through groove section and the right through groove section, a left plate section is disposed on a left side of the left through groove section, and a right plate section is disposed on a right side of the right through groove section;

folding the left plate section toward the middle plate-shaped section, such that the left through groove section overlaps the left plate section, and a part of the left plate section blocks two or more through groove openings of the left through groove section, and folding the right plate section toward the middle plate-shaped section, such that the right through groove section overlaps the right plate section, and a part of the right plate section blocks two or more through groove openings of the right through groove section;

refolding the left through groove section and the left plate section that overlap with each other toward the middle plate section, such that the left through groove section overlaps the middle plate section, a part of the middle plate section blocks remaining through groove openings of the left through groove section, and a part of the left plate section that does not overlap the left through groove section forms a left extension portion; and refolding the right through groove section and the right plate section that overlap with each other toward the middle plate section, such that the right through groove section overlaps the middle plate section, a part of the middle plate section blocks remaining through groove openings of the right through groove section, and a part of the right plate section that does not overlap the right through groove section forms a right extension portion, wherein after the folding, a right end of the left through groove section is adjacent to a left end of the right through groove section.

14. The heat exchange tube according to claim 3, wherein the body portion further comprises an inner baffle arranged in the cavity, the inner baffle separates the cavity into the plurality of flow channels, and the tube walls, the extension portion, and the inner baffle are formed by bending the same plate material.

15. The heat exchange tube according to claim 2, wherein a length of the extension portion is less than a length of the body portion.

16. A processing method for a heat exchange tube, comprising:

preparing a plate-shaped piece; and folding a first plate section of the plate-shaped piece into a tube body having a cavity enclosed by two opposite bottom walls and two opposite side walls, wherein a second plate section of the plate-shaped piece forms an extension portion on at least one side of the tube body, and the extension portion joins one bottom wall of the tube body, wherein when the first plate section of the plate-shaped piece is folded into the tube body, a part of the first plate section is bent to form an inner baffle separating the cavity into a plurality of flow channels, wherein a partial plate section on a left side of the plate-shaped piece is bent multiple times to form a left through groove section with a plurality of through grooves, the through groove of the left through groove section has an opening on one side in a thickness direction of the tube body, openings of two adjacent through grooves of the left through groove section face in opposite directions, and a left plate-shaped section of a specified length is disposed on a left side of the left through groove section;

wherein a partial plate section on a right side of the plate-shaped piece is bent multiple times to form a right through groove section with a plurality of through grooves, the through groove of the right through groove section has an opening on one side in the thickness direction of the tube body, openings of two adjacent through grooves of the right through groove section face in opposite directions, and a right plate-shaped section of a specified length is disposed on a right side of the right through groove section, wherein a middle plate-shaped section of a preset length is disposed between the left through groove section and the right through groove section, wherein the left plate-shaped section and the right plate-shaped section are folded toward each other, such that a part of the left plate-shaped section covers the through grooves of the left through groove section and overlaps the middle plate-shaped section, and a part of the right plate-shaped section covers the through grooves of the right through groove section and overlaps the middle plate-shaped section, wherein a left part of the middle plate-shaped section is bent downward, such that the left plate-shaped section and the left through groove section that overlap with each other are bent together downward, and after the bending, a part of the left plate-shaped section is located above the middle plate-shaped section, and a right part of the middle plate-shaped section is bent downward, such that the right plate-shaped section and the right through groove section that overlap with each other are bent together downward, and after the bending, a part of the right plate-shaped section is located above the middle plate-shaped section, and wherein the left plate-shaped section and the left through groove section that overlap with each other are then bent inward to overlap a left part of an unbent middle plate-shaped section, the right plate-shaped section and the right through groove section that overlap with each other are then bent inward to overlap a right part of the unbent middle plate-shaped section, and after the bending, a right end of the left through groove section is adjacent to a left end of the right through groove section.

* * * * *